United States Patent [19]

Soyama et al.

[11] Patent Number: 4,584,954

[45] Date of Patent: Apr. 29, 1986

[54] DETECTOR FOR USE ON SEWING MACHINES

[75] Inventors: Kazuya Soyama, Nagano; Takashi Nakamura; Yutaka Yamaura, both of Aichi, all of Japan

[73] Assignee: Mitsubishi Denki Kabushiki Kaisha, Tokyo, Japan

[21] Appl. No.: 474,642

[22] PCT Filed: Jul. 10, 1982

[86] PCT No.: PCT/JP82/00261

§ 371 Date: Mar. 1, 1983

§ 102(e) Date: Mar. 1, 1983

[87] PCT Pub. No.: WO82/02848

PCT Pub. Date: Sep. 2, 1982

[30] Foreign Application Priority Data

| | | | |
|---|---|---|---|
| Jul. 10, 1981 | [JP] | Japan | 56-107876 |
| Jul. 10, 1981 | [JP] | Japan | 56-107877 |
| Jul. 10, 1981 | [JP] | Japan | 56-107878 |
| Jul. 10, 1981 | [JP] | Japan | 56-102724[U] |
| Jul. 10, 1981 | [JP] | Japan | 56-102725[U] |

[51] Int. Cl.[4] ..... D05B 69/24

[52] U.S. Cl. ..... 112/275; 318/467; 250/233

[58] Field of Search ..... 112/275, 277, 220, 221; 318/275, 467; 250/233, 230

[56] References Cited

U.S. PATENT DOCUMENTS

| | | | |
|---|---|---|---|
| 3,683,294 | 8/1972 | Gaa | 112/275 X |
| 4,072,415 | 2/1978 | Inoue et al. | 250/233 X |
| 4,183,312 | 1/1980 | Angersbach | 112/277 |
| 4,463,698 | 8/1984 | Shinozaki et al. | 112/275 |

FOREIGN PATENT DOCUMENTS

| | | | |
|---|---|---|---|
| 5566388 | 5/1980 | Japan | 112/275 |

OTHER PUBLICATIONS

Yamazaki, "Electro-Magnetic Needle Positioner", 6-1977, p. 461.

*Primary Examiner*—Peter Nerbun

*Attorney, Agent, or Firm*—Sughrue, Mion, Zinn Macpeak & Seas

[57] ABSTRACT

A plurality of photoelectric detector plates are mounted in successive layers on a coupling secured to a sewing machine arm shaft, and have light shields disposed concentrically so as not to be overlapped. Light-emitting means is arranged on one side of the photoelectric detector plates for emitting light toward the latter, and photodetector means is positioned on the other side of the photoelectric detector plates for receiving the light from the light-emitting means. Conditions of the sewing machine can be detected by the manner in which the photodetector means receives the light. The photoelectric detector plates are pressed axially of the coupling and adjustable into given angular positons, respectively, with respect to the coupling.

9 Claims, 8 Drawing Figures

DETECTOR FOR USE ON SEWING MACHINES

DESCRIPTION

1. Technical Field

The present invention relates to a detector for use on a sewing machine, and more particularly to a sewing machine detector mounted on a sewing machine arm shaft.

2. Background Art

There are known sewing machines such as those for industrial use in which various modes of stitching control are automatically effected. It is necessary in such sewing machines that a pulse generator for speed control, that is, a pulse generator for detecting the speed of rotation of an arm shaft of the sewing machine be provided, and detection be made of an upper needle position, a lower needle position, and a timing for cutting off a needle thread. For such detection, there has conventionally been employed a detector comprising a magnetized ring magnet and a Hall-effect element, the ring magnet being secured to the sewing machine arm shaft.

In order to carry out reliable detection, the ring magnet of the prior detector is required to be relatively large in size, particularly thick, and hence the detector per se is of a large size. Due to a large moment of inertia, the detector is disadvantageous in that its rotatable part or magnet tends to be damaged especially when used on high-speed sewing machines which become available in recent years. Another difficulty with the conventional detector is that the detecting position and the like of the detector cannot easily be adjusted or otherwise changed dependent on the type or mode of use of the sewing machine.

DISCLOSURE OF THE INVENTION

The present invention has been made in view of the foregoing prior problems. It is an object of the present invention to provide a detector for use on sewing machines which is small in size, lightweight, capable of detection with high accuracy, and has its detecting position easily adjusted.

To achieve the above object, there is provided according to the present invention a detector for use on a sewing machine, comprising a coupling secured to an arm shaft of the sewing machine, a base supported on the coupling and having one end engaging a body of the sewing machine and held at rest in a given position, a plurality of photoelectric detector plates coaxially removably mounted in axially successive layers on the coupling and having light shields disposed concentrically so as not to be overlapped, and light-emitting and photodetector means fixed to the base and arranged one on each side of the set of photoelectric detector plates, said photoelectric detector plates being pressed axially of the coupling by presser means and each adjustable in a given angular position with respect to the coupling.

BEST MODE FOR CARRYING OUT THE INVENTION

A preferred embodiment of the present invention will be described hereinbelow with reference to the drawings.

Figure 1:
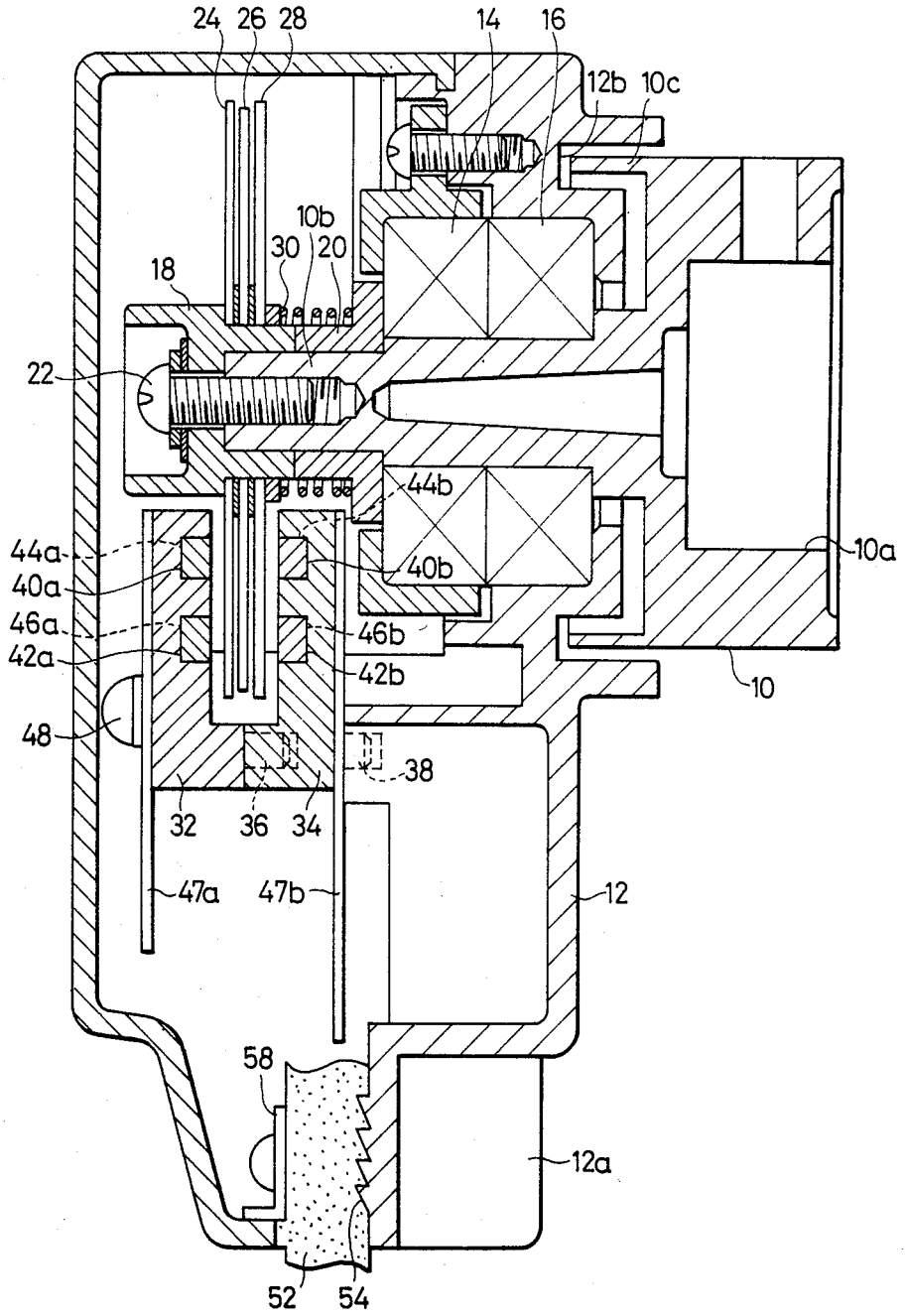
FIG. 1 is a cross-sectional view of a detector for use on a sewing machine according to the present invention.

FIG. 1 shows in cross section a detector for use on a sewing machine according to the present invention.

As shown in FIG. 1, a sewing machine detector includes a coupling 10 having one end 10*a* fixed to a sewing machine arm shaft (not shown) and a base 12 supported on the coupling 10 and having one end 12*a* engaging a sewing machine body (not shown) and held at rest in a given position. There are bearings 14, 16 through which the coupling 10 and the base 12 are interconnected, the coupling 10 being rotatable in the base 12 by the bearings 14, 16.

The coupling 10 has a projecting ring 10*c* extending in an area in which the coupling 10 and the base 12 are disposed in confronting and close relation to each other. The base 12 has a ring-shaped groove 12*b* positioned in such an area.

The coupling 10 also has a distal end 10*b* over which are fitted collars 18, 20 that are separated axially of the coupling 10 and slippingly rotatable, the collars 18, 20 being fastened to the coupling 10 by a screw 22. Three photoelectric detector plates 24, 26, 28 are coaxially removably secured to the collar 18 and arranged in successive layers axially of the coupling 10. The photoelectric detector plates 24, 26, 28 are pressed by a compression spring 30 having one end engaged by the collar 20. The end detector plates 24, 28 are slippingly rotatable while the intermediate detector plate 26 is disposed nonrotatably on the collar 18. The photoelectric detector plates 24, 28 can rotate independently of one another. Furthermore, by rotating the collar 18 after loosening the screw 22, all of the photoelectric detector plates 24, 26, 28 can simultaneously be rotated with respect to the coupling 10. The collar 20 serves to engage the end of the spring 30 and also to prevent the coupling 10 from being pulled out of the bearings 14, 16.

Figure 2:
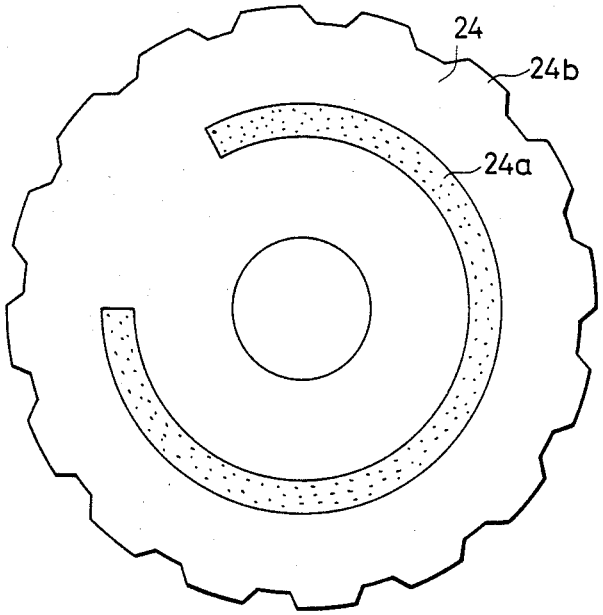
FIGS. 2, 3 and 4 are side elevational views of photoelectric detector plates, respectively.
Figure 3:
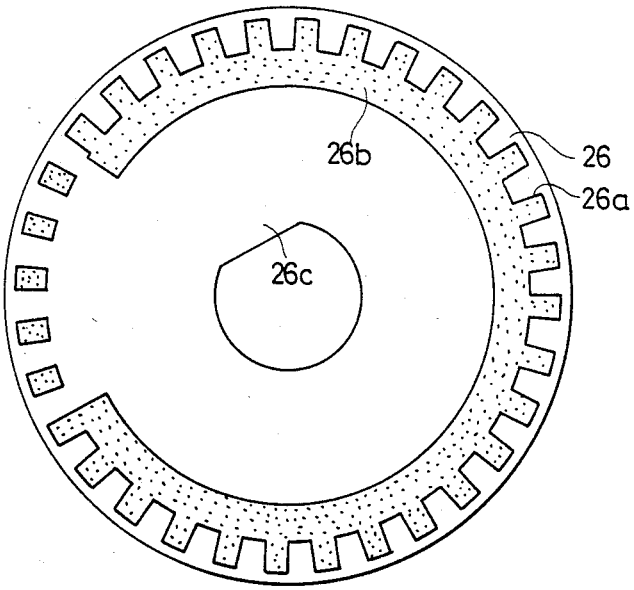
Figure 4:
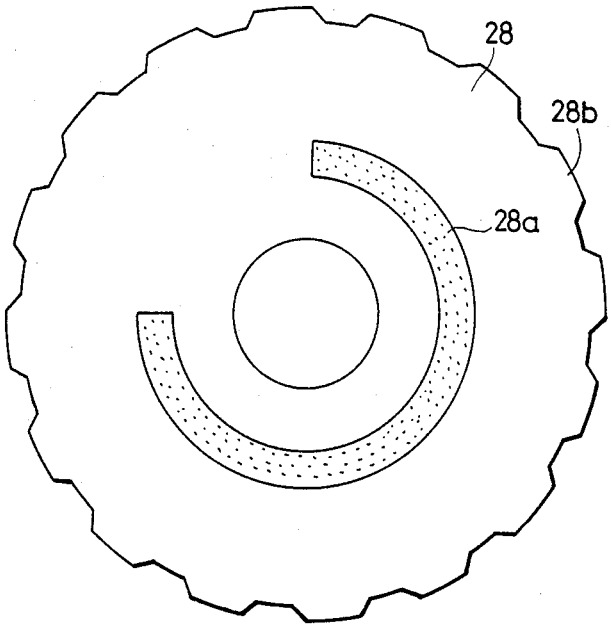

FIGS. 2, 3 and 4 illustrate the photoelectric detector plates 24, 26, 28, respectively.

In FIGS. 2, 3 and 4, the photoelectric detector plate 24 serves to detect a lower needle position, the photoelectric detector plate 26 serves to cooperate with a pulse generator for detecting the speed of rotation of the sewing machine arm shaft and also to detect an upper needle position, and the photoelectric detector plate 28 serves to detect a timing for cutting off a needle thread, the photoelectric detector plates 24, 26, 28 being made of transparent material capable of transmitting light therethrough. Light shields 24*a*, 26*a*, 26*b*, 28*a* are marked as by printing on the photoelectric detector plates 24, 26, 28, respectively, in concentric relation so as not to be overlapped. The light shields 24*a*, 26*a*, 26*b*, 28*a* are effective to detect the lower needle position, the rotation of the sewing machine arm shaft, the upper needle position, and the timing for cutting off the needle thread, respectively. As illustrated in FIG. 3, the photoelectric detector plate 26 has a rotation stop 26*c* by which the photoelectric detector plate 26 is secured in position on the collar 18. Instead of employing the collars 18, 20, the intermediate photoelectric detector plate 26 may be of an inside diameter selected such that the plate 26 frictionally engages the coupling 10, and the photoelectric detector plates 24, 28 may be of an inside diameter selected such that they will loosely fit over the coupling 10. With this arrangement, the photoelectric detector plates 24, 28 can rotate separately, and all of the photoelectric detector plates 24, 28 can rotate simultaneously with respect to the coupling 10 without loosening the screw 22. The photoelectric detector plates 24, 28 have projections **24*b*, 28*b***, respectively, positioned at equal intervals therearound.

As shown in FIG. 1, a pair of sensor blocks 32, 34 are provided one on each side of the set of photoelectric detector plates 24, 26, 28. The sensor block 32 is positioned on the sensor block 34 by a boss 36, and the sensor block 34 is positioned on the base 12 by a boss 38, the sensor blocks 32, 34 being affixed to the base 12 by means of a screw 48.

The sensor block 32 has light-emitting devices **40*a*, 42*a*, 44*a*, 46*a* on a surface thereof facing the photoelectric detector plate, and the sensor block 34 has on a surface thereof facing the photoelectric detector plate photodetectors 40*b*, 42*b*, 44*b*, 46*b* which are located in axial alignment with the light-emitting devices 40*a*, 42*a*, 44*a*, 46*a*, respectively. The sensor block 32 has a printed-circuit board 47*a* on which desired circuits of the light-emitting devices 40*a*, 42*a*, 44*a*, 46*a* are formed, and the sensor block 34 has a similar printed-circuit board 47*b***.

According to the present invention, desired detections on the sewing machine are made by means of the photoelectric detector plates 24, 26, 28 and the four light-emitting devices **40*a*, 42*a*, 44*a*, 46*a* and the four photodetectors 40*b*, 42*b*, 44*b*, 46*b***.

Figure 5:
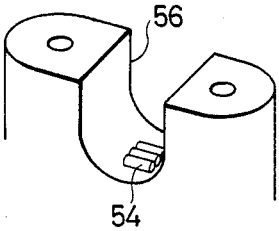
FIGS. 5 and 6 are views illustrative of grooves.
Figure 6:
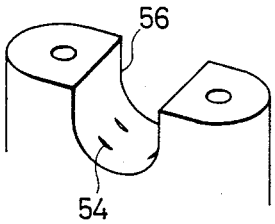
Figure 7:
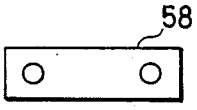
FIGS. 7 and 8 are views illustrative of a presser plate.
Figure 8:
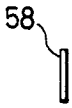

A lead wire 52 for supplying electric power is fixed to the base 12 by a groove 56 having ridges 54 on its inner periphery as shown in FIG. 5 or 6 and a presser plate 58 as illustrated in FIGS. 7 and 8.

The detector on the sewing machine according to the present invention is of the foregoing construction, and its operation will now be described.

In FIG. 1, photoelectric detector plates 24, 26, 28 that are selected dependent on the type of a sewing machine used or a mode of use thereof are mounted as successive layers on the collar 18. When the coupling 10 fixed to the sewing machine arm shaft is rotated, the photoelectric detector plates 24, 26, 28 are rotated, thus intermittently shielding light emitted from the light-emitting devices **40*a*, 42*a*, 44*a*, 46*a* with the light shields 24*a*, 26*a*, 26*b*, 28*b*. The intermittent beams of light are received by the photodetectors 40*b*, 42*b*, 44*b*, 46*b*** for effecting desired detection.

With this embodiment, the photoelectric detector plates 24, 28 can slippingly rotate independently of each other with respect to the collar 18, so that the light shields **24*a*, 28*a* on the photoelectric detector plates 24, 28 can be adjusted in desired angular positions with respect to the coupling 10. Although the photoelectric detector plate 26 is nonrotatably secured to the collar 18, since the latter can be rotated by loosening the screw 22, all of the photoelectric detector plates 24, 26, 28 can simultaneously be rotated with respect to the coupling 10 so that the light shields 24*a*, 26*a*, 28*a* on the photoelectric detector plates 24, 26, 28 can be adjusted into given angular positions, respectively, at the same time with respect to the coupling 10. The collar 18 can be removed by loosening the screw 22, allowing the photoelectric detector plates 24, 26, 28** to be replaced with another set to meet the sewing machine type or mode of use of the sewing machine. Therefore, photoelectric detector plates having desired light shields can be attached to the sewing machine detector.

With the projections **24*b*, 28*b* around the photoelectric detector plates 24, 28, the latter can easily be rotated while adjusting the photoelectric detector plates 24, 26, 28 into given angular positions relative to the coupling 10**.

The lead wire 52 is prevented from being removed from the base 12 since the lead wire 52 is secured to the base 12 by the groove 56 having the ridges 54 on its inner periphery and the presser plate 58.

The ridges 54 may be located at the bottom of the groove 56 as shown in FIG. 5, or at sides of the groove 56 as shown in FIG. 6.

In the area in which the coupling and the base are disposed in confronting and close relation to each other, the coupling 10 has the projecting ring **10*c*, and the base has the ring-shaped groove 12*b*, an arrangement which prevents a thread from being entangled in the area. If the area were exposed, a sewing thread hanging in the vicinity of the coupling 10 would be caught at its hanging end between the coupling 10 and the bearing 16, resulting in troubles such as stoppage of the arm shaft. In the event of such a thread entanglement, the sewing machine detector would have to be disassembled for removing the entangled thread. This would be quite a tedious and time-consuming task. With the embodiment of the present invention, the ring-shaped groove 12*a* and the projecting ring 10*c* jointly define a double maze which a thread cannot find its way therethrough. Accordingly, the thread entanglement can be prevented substantially completely. The maze is defined by the projecting ring 10*c* extending into the ring-shaped groove 12*b*, a construction which keeps the overall thickness reduced in a direction toward the axis. The same result can be attained by providing a ring-shaped groove in the coupling 10 and a projecing ring on the base 12**.

As described above, a detector for use on a sewing machine according to the present invention is small in size, lightweight, capable of detection with high accuracy, and has its detecting position easily adjusted.

What is claimed is:

1. A detector for use on a sewing machine, comprising a coupling secured to an arm shaft of the sewing machine, a base supported on the coupling and having one end engaging a body of the sewing machine and held at rest in a given position, a plurality of photoelectric detector plates coaxially mounted in axially successive layers on the coupling and slippingly rotatable thereon, said photoelectric detector plates having light shields disposed concentrically so as not to be overlapped, and light-emitting and photodetector means fixed to the base and arranged one on each side of the set of photoelectric detector plates, each of said light-emitting and photodetector means being at least two in number and mounted on one and same plane, said photoelectric detector plates being pressed axially of the coupling by presser means and each adjustable in a given angular position with respect to the coupling.

2. A detector according to claim 1, wherein at least one of said photoelectric detector plates has projections around its periphery for facilitating rotation of the photoelectric detector plates when the latter are to be adjusted into given angular positions with respect to the coupling.

3. A detector for use on a sewing machine, comprising a coupling secured to an arm shaft of the sewing machine, a base supported on the coupling and having one end engaging a body of the sewing machine and held at rest in a given position, a plurality of photoelectric detector plates coaxially mounted in axially successive layers on the coupling and slippingly rotatable thereon, said photoelectric detector plates having light shields disposed concentrically so as not to be overlapped, and light-emitting and photodetector means fixed to the base and arranged one on each side of the set of photoelectric detector plates, said photoelectric detector plates being pressed axially of the coupling by presser means, said coupling supporting a collar slippingly rotatable around a distal end of the coupling, one of said photoelectric detector plates having a rotation stop and being secured in position on the collar, the other photoelectric detector plates being mounted on the collar and slippingly rotatable thereon independently of each other, whereby all of said photoelectric detector plates can be rotated simultaneously with respect to the coupling by rotating said collar.

4. A detector according to claim 3, wherein said collar is divided into two members axially of the coupling, said presser means comprising a spring having one end engaged by the collar, which serves to secure bearings in place.

5. A detector for use on a sewing machine, comprising a coupling secured to an arm shaft of the sewing machine, a base supported on the coupling and having one end engaging a body of the sewing machine and held at rest in a given position, said base having a groove with ridges on its inner periphery and a removable presser plate with a lead wire being fixed by said groove and said presser plate, a plurality of photoelectric detector plates coaxially mounted in axially successive layers on the coupling and slippingly rotatable thereon, said photoelectric detector plates having light shields disposed concentrically so as not to be overlapped and being adjustable into given angular positions, respectively, with respect to the coupling, and light-emitting and photodetector means secured to the base and arranged one on each side of the set of photoelectric detector plates.

6. A detector according to claim 1, at least one of said photoelectric detector plates having a plurality of light shield disposed thereon.

7. A detector according to claim 3, at least one of said photoelectric detector plates having a plurality of light shields disposed thereon.

8. A detector according to claim 5, at least one of said photoelectric detector plates having a plurality of light shields disposed thereon.

9. A detector for use on a sewing machine, comprising a coupling secured to an arm shaft of the sewing machine, a base supported on the coupling and having one end engaging a body of the sewing machine and held at rest in a given position, and detector means for issuing a position detecting signal in coaction with a plurality of position detector plates secured to the coupling, one of said coupling and said base having a first ring-shaped projection extending from a main portion thereof and the other of said coupling and said base having a second ring-shaped projection extending from a main portion thereof, and further having a ring-shaped groove which receives said first ring-shaped projection, said groove being formed by an elevated portion of the main portion of said other of said coupling and said base and said second ring-shaped projection, whereby said groove extends into the main portion of said other of said coupling an said base, the coupling and the base being disposed in confronting and close relation to each other for thereby preventing a thread from being entangled in the area.

* * * * *